US005689276A

United States Patent [19]

Uematsu et al.

[11] Patent Number: 5,689,276

[45] Date of Patent: Nov. 18, 1997

[54] HOUSING FOR ANTENNA DEVICE

[75] Inventors: Masahiro Uematsu; Nobuharu Takahashi; Motonobu Moriya; Takashi Ojima, all of Tokyo, Japan

[73] Assignee: Nippon Steel Corporation, Tokyo, Japan

[21] Appl. No.: 416,095

[22] Filed: Apr. 4, 1995

[30] Foreign Application Priority Data

| | | | |
|---|---|---|---|
| Apr. 7, 1994 | [JP] | Japan | 6-093647 |
| Apr. 11, 1994 | [JP] | Japan | 6-096913 |
| Apr. 11, 1994 | [JP] | Japan | 6-096914 |

[51] Int. Cl.[6] ..... H01Q 1/32; H01Q 1/42

[52] U.S. Cl. ..... 343/872; 343/713; 343/766

[58] Field of Search ..... 343/872, 713, 343/757, 765, 766; H01Q 1/32, 1/42

[56] References Cited

U.S. PATENT DOCUMENTS

| | | | |
|---|---|---|---|
| 3,444,558 | 5/1969 | Leitner | 343/872 |
| 4,661,821 | 4/1987 | Smith | 343/872 |
| 4,698,638 | 10/1987 | Branigan | 343/770 |
| 4,914,448 | 4/1990 | Otsuka et al. | 343/700 MS |

FOREIGN PATENT DOCUMENTS

| | | | |
|---|---|---|---|
| 262703 | 10/1990 | Japan | 343/700 MS |
| 3-182031 | 1/1993 | Japan . | |
| 5-83022 | 4/1993 | Japan | H01Q 1/42 |
| 1588872 | 4/1981 | United Kingdom | 343/872 |

*Primary Examiner*—Hoanganh T. Le

*Attorney, Agent, or Firm*—Pollock, Vande Sande & Priddy

[57] ABSTRACT

An antenna housing functions as a radome for a satellite antenna device for mounting on a moving body. The housing includes a lower portion on which the antenna device, having an antenna body and an automatic tracking mechanism, is fixedly mounted and an upper portion releasably connected to the lower portion in a watertight manner. The upper portion is made of a dielectric material and composed of a single layer of a resin having a relative dielectric constant of no more than 2. The upper portion is spaced from a surface of the antenna body by a distance except for values close to an integral multiple of a half-wave length.

6 Claims, 4 Drawing Sheets

HOUSING FOR ANTENNA DEVICE

1. Field of the Invention

The present invention relates generally to a housing or container for an antenna device, and more particularly to a radome-like housing for a satellite antenna device mounted on a moving body, such as a bus or a ship, for receiving radio waves from satellite broadcasting.

2. Background of the Invention

Recently, with the spread of satellite broadcasting, there have been developed antenna devices that can be mounted on various kinds of moving bodies, for example, a sightseeing bus or a sightseeing ship, to receive satellite broadcasting so that sightseers can enjoy satellite broadcasting programs. Differently from the satellite antenna devices installed on a house or building, the direction of such a moving body-carried satellite antenna device with respect to the satellite varies with time following the movement of the moving body. Therefore it is necessary to provide an automatic tracking mechanism to always direct the antenna towards the satellite.

Such an automatic tracking mechanism is provided with precision parts including gears, and in order to protect these parts from rain water and dust so that they will not rust and fail to move smoothly, the whole antenna device including the tracking mechanism is housed in a watertight housing or container. Such a prior art housing is disclosed in Japanese Patent Application No. 3-182031 filed previously by the Applicant of the present application. This prior art housing includes a concave lower portion 5 on which a satellite antenna device is fixedly mounted, and an upper portion 6, also called "radome", of a cup-shape secured to the lower portion 5 in an inverted manner, as shown in a sectional view of FIG. 5.

The lower portion 5 does not include any wave propagation path, and therefore may be made of any suitable material such as metal or resin. On the other hand, the upper portion 6 includes wave propagation paths, and therefore need to be made of a dielectric material such as resin. The lower and upper portions 5 and 6 are held together watertight at their flanges *5a* and *6b* (which are formed respectively at their peripheral edges) through an O-ring 9, and are releasably fastened together by bolts 7 and nuts 8. The lower portion 5, as well as the upper portion 6, assume an accurately circular shape as viewed from above.

At least the upper portion of the above conventional housing composed of the concave upper and lower portions is made of a dielectric material such as resin, and therefore it is difficult to form the flange at its peripheral edge by steep bending. Therefore, at least the upper portion is formed by injection molding. A mold for forming the upper portion becomes complicated and hence expensive because of the provision of the flange at the peripheral edge, which results in increased manufacturing cost.

In the current satellite broadcasting, waves of a relatively high frequency band such as 12 GHz band are used, and a wavelength thereof is small on the order of about 25 mm. If such a satellite broadcasting-receiving antenna is mounted on a moving body such as a vehicle, it is necessary to reduce as much as possible the height of mounting of the overall structure including the radome since it is mounted on the top of the vehicle with a height limitation. To reduce mounting height, there has recently been developed a flat slot array antenna which is installed generally horizontally with a beam tilt angle of about 50° which is a wave angle with respect to a geostationary satellite. Further details of this antenna are disclosed in an article entitled "Vehicle-carried Satellite Broadcasting Receiving Single-layer Structure Leaky-wave Waveguide Slot Array Antenna" and written by Hirokawa et al. in Technical Report of "Institute of Electronic Information Communication" (Vol. 93 No. 40). In such a flat antenna, unless a radome is mounted substantially horizontally as close to an antenna body as possible, the height of a housing including the radome can not be reduced, and the flat design of the antenna body will become meaningless.

However, it has been found from the tests conducted by the inventor of the present invention that if the radome is mounted close to the flat array antenna having the above beam tilt angle, the receiving gain of the antenna body varies unexpectedly greatly by several dB, depending on the wall thickness of the radome, its relative dielectric constant, the distance between the radome and the antenna body, and so on. This phenomenon that the receiving gain is greatly varied, and the variation depends on the distance between the radome and the antenna body can not be explained by a transmission loss of waves due to the dielectric tangent of the dielectric material constituting the radome or by reflection of waves on the surface of the radome. This phenomenon suggests that in the optimum design of receiving characteristics of a flat array antenna by an electromagnetic analysis, it should be necessary to beforehand take the presence of the radome (equivalently, the dielectric layer) into consideration. An electromagnetic analysis in view of such a dielectric layer becomes considerably complicated.

In contrast, seems advisable to positively utilize the fact that the presence of the radome will influence the receiving characteristics of the antenna. More specifically, the receiving characteristics of the antenna are usually out of the range of the optimum value because of the incompleteness of the analysis model and manufacturing errors, and in such a case it is thought that by adjusting the relative dielectric constant of the radome, the wall thickness thereof, and the distance between the radome and the flat array antenna to their respective optimum values, the receiving characteristics of the flat array antenna itself makes it possible to improve the deviation from an optimum value thereof.

However, when trying to optimize the configuration of the antenna body, the thickness of the radome, the relative dielectric constant thereof, and the distance between the radome and the antenna body by effecting the electromagnetic analysis in view of the dielectric layer, another problem arises. More specifically, in accordance with the latitude of the area where the antenna is used, the wave angle of the antenna need to be varied over a range of several degrees in a discrete manner, or need to be varied continuously in accordance with the wave-receiving condition. As a result, the positional relation between the antenna and the radome varies to come out of the range of the optimization condition. Furthermore, it has been confirmed by the results of the tests conducted by the inventor of the present invention that the gain of the antenna body can vary considerably even with a slight difference of the frequency. For example, the center frequencies of Channel 5 and Channel 7 of the current satellite broadcasting are 11.804 GHz and 11.919 GHz, respectively, and the difference between the two is only about 1% in terms of the absolute value; however, it has been confirmed that the antenna gain varies several dB between the two.

SUMMARY OF THE INVENTION

With the above problems in view, it is one object of this invention to provide a radome-like housing for an antenna device which is capable of keeping the reduction of a receiving gain of a flat array antenna of the antenna device to a minimum.

Another object of the invention is to provide a housing for an antenna device which is made at reduced manufacturing cost, and is made compact by omitting the provision of a flange at a peripheral edge of the housing.

The above object has been achieved by a housing for an antenna device including an antenna body and an automatic tracking mechanism, the housing comprising a lower portion on which the antenna device is fixedly mounted, and an upper portion releasably connected to the said lower portion in a watertight manner, the upper portion being made of a dielectric material. The upper portion includes single layer of a resin having a relative dielectric constant of no more than 2.

The upper portion includes single layer of a resin having a relative dielectric constant of no more than 2, and the single resin layer has a thickness except for values close to an integral multiple of a quarter of a wavelength of transmitting/receiving waves, and the upper portion is spaced from a surface of the antenna body by a distance except for values close to an integral multiple of a half-wave length of the transmitting/receiving waves.

For example, the dielectric resin of a low relative dielectric constant comprises an acrylonitrile-butadiene-styrene copolymer as a main component, and has a relative dielectric constant of about 1.

Thus, by approaching the relative dielectric constant of the upper portion toward "1" which is the value of the dielectric constant of the ambient air, effects on an electromagnetic field in the vicinity of the flat array antenna can be reduced. The material of such a low relative dielectric constant can be formed by a foamed styrol or cloth containing a large amount of the air in layers.

However, a foamed material is less practical because of a low strength. Also, cloth is less practical because of its waterproof property and water absorption coefficient. It may be proposed to provide a laminate structure in which a resin layer, having a high strength though having a high relative dielectric constant, is bonded to each side of a foamed styrol sheet to thereby lower the equivalent relative dielectric constant; however, the process for the manufacture of such a laminate structure is complicated, makes the automatization difficult, and the manufacturing cost is increased.

Among the existing materials that can be used for forming a radome in view of a strength, watertightness and a water absorption property, a fluorine contained resin (PTFE) has the lowest relative dielectric constant but which is still about 2.1. Thus, there has not heretofore existed any material having a relative dielectric constant of no more than 2. In the present invention, single layer of a resin having a relative dielectric constant of no more than 2 is used as a material for forming the radome. One preferred example of such resin includes an acrylonitrile-butadiene-styrene copolymer as a main component, and has a relative dielectric constant of about 1. As the relative dielectric constant of the dielectric material approaches "1", the influence of the radome on the receiving characteristics of the antenna becomes smaller. Therefore, it is only necessary to design the antenna itself in an optimum manner, and the time and labor required for the optimum design are greatly reduced. Besides, even if the wave angle of the antenna is changed, the variation of the receiving gain becomes less.

The above object have been achieved by an antenna housing which includes a lower portion made of metal having a bottom wall on which an antenna device is fixedly mounted, and a side wall of a generally inverted U-shaped cross section which raises generally from a peripheral edge of the bottom portion to the outerside thereof, and then declines outwardly. An upper portion of the housing is made of a dielectric material, and includes a generally flat top wall, and a side wall declining from a peripheral edge of the top wall outwardly to be held in contact with the obliquely downwardly-extending portion of the inverted U-shaped side wall of the lower portion, thus forming a contact surface therebetween. The housing for the satellite antenna further includes screw means releasably connecting the side walls of the upper and lower portions to each other at the contact surface.

The upper portion has a simple concave shape having no flange at its peripheral edge. Therefore a mold required for injection molding the upper portion is simple in configuration, and the manufacturing cost is reduced. Although the side wall of the lower portion is steeply bent to assume an inverted U- shape, the lower portion can be easily processed or worked into the required configuration by bending since the lower portion is made of a metal sheet. The upper and lower portions are positively releasably fastened together at the surface of contact between their side walls by the screw means. A watertight seal at the contact surface between the two side walls, particularly at those potions where the screw means is provided, is suitably ensured by a strip-like covering member which covers this contact surface and has a waterproof property and elasticity.

DETAILED DESCRIPTION OF THE PREFERRED EMBODIMENTS

A resin, "ABK", of a low relative dielectric constant, purchased from TSUTSUNAKA PLASTIC INDUSTRY KABUSEIKI KAISHA (1–17, Koishikawa 3-Chome, Bunkyo-Ku, Tokyo, Japan), includes an acrylonitrile-butadiene-styrene (ABS) copolymer as a main component, and with this composition, "ABK" exhibits a low relative dielectric constant of no more than 2. Measured values of various physical properties of "ABK" are shown in Table 1 below.

TABLE 1

| Item | Test and Unit | Value |
|---|---|---|
| Specific gravity | ASTM | 1.47 |
| Hardness | ASTM Rscale | 58 |
| Tensile strength | JIS | Lengthwise: 21<br>Widthwise: 14 |

TABLE 1-continued

| Item | Test and Unit | Value |
|---|---|---|
| Elongation | JIS % | Lengthwise: 25<br>Widthwise: 15 |
| Bending strength | ASTM $N/mm^2$ | Lengthwise: 32<br>Widthwise: 27 |
| Bending modulus | ASTM $N/mm^2$ | Lengthwise: 1380<br>Widthwise: 1160 |
| Compression strength | ASTM $N/mm^2$ | 57 |
| Izot impact strength | JIS $Kg/m^2$ | Lengthwise: 2.2<br>Widthwise: 2.2 |
| Deflection temperature under load | JIS °C. | 65–68 |
| Thermal deformation temperature | ASTM °C. | 61–63 |
| Linear expansion coefficient | ASTM $10^{-5}$/°C. | 7 |
| Thermal conductivity | ASTM Kcal/m · hr · °C. | 0.07 |
| Overheat thermal stretchability | JIS % | Lengthwise: −3<br>Widthwise: +2 |
| Flammability | JIS | Self-extinguishing properties |
| Surface resistivity | ASTM Ω | not less than $10^{15}$ |
| Volume resistivity | ASTM Cm · Ω | not less than $10^{15}$ |
| Dielectric breakdown strength | JIS Kv/mm | 8.3 |
| Relative dielectric constant 1 MHz | ASTM | 1.0 |
| Dielectric loss tangent | ASTM | 0.0015 |
| Coefficient of water absorption | ASTM % | 0.09 |

In Table 1, the relative dielectric constant is also substantially 1 in the high frequency as in a satellite broadcasting, for example, in case of 12 GHz. Further, in case of using materials such as fluorine contained resin and an epoxy resin, the relative dielectric constant is larger than 2 in the high frequency of 12 GHz. Thus, it is to be noted that the relative dielectric constant is 1. It is also to be noted that all of those materials, fluorine contained resin and an epoxy resin, heretofore used for forming a radome have a relative dielectric constant of more than 2.0. It is further to be noted that "ABK" is not inferior to the various conventional dielectric materials for the radome in those physical properties important for the radome such as a mechanical strength, a water absorption coefficient and a dielectric loss tangent.

Figure 1:
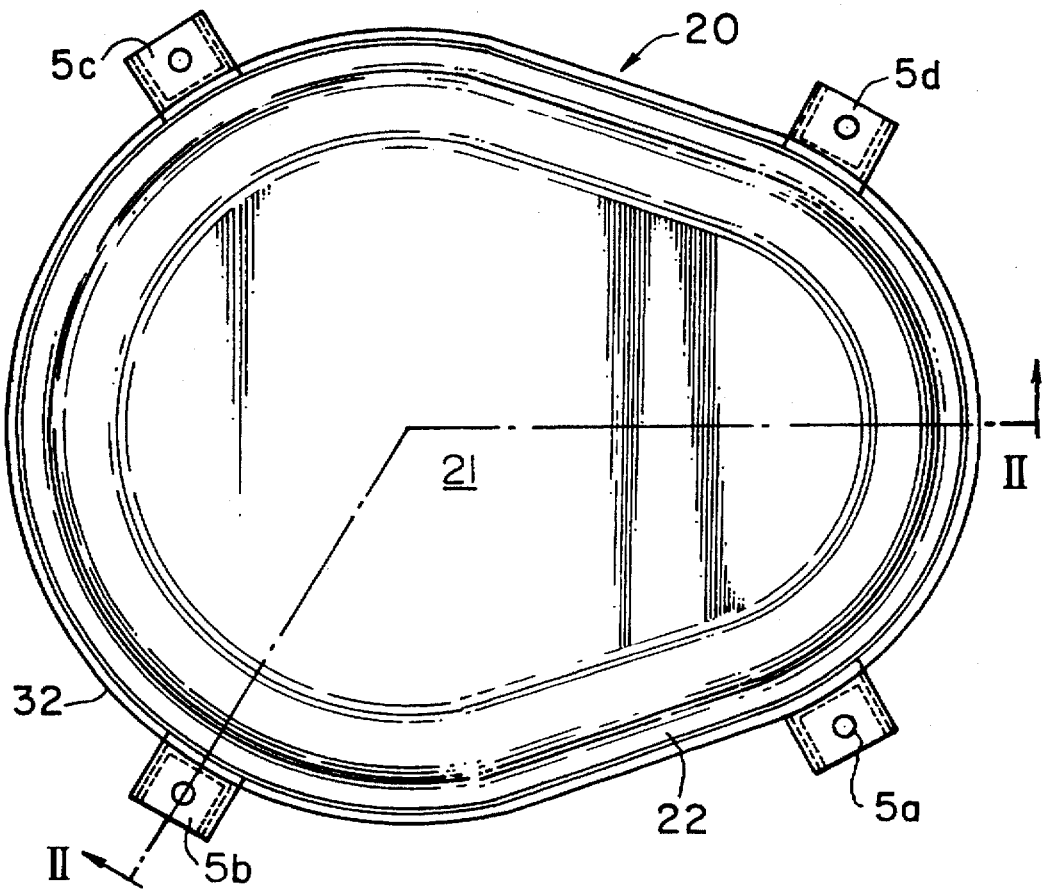
FIG. 1 is a plan view of a housing according to the invention including a radome.
Figure 2:
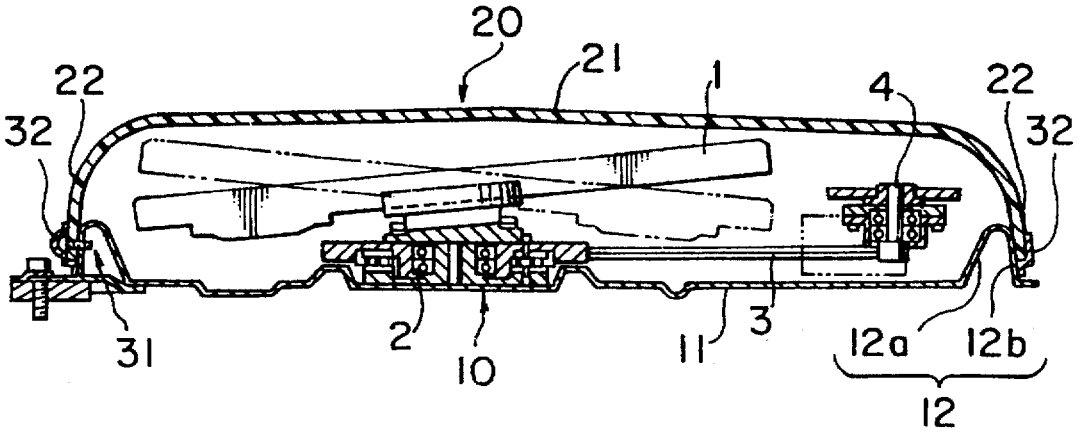
FIG. 2 is a cross-sectional view taken along the line II—II of FIG. 1, showing a flat antenna device together with the housing.

FIG. 1 is a plan view of a housing (or container) including a radome according to the present invention, and FIG. 2 is a cross-sectional view taken along the line II—II of FIG. 1, showing the housing as well as an antenna device for mounting on a moving body. As shown in FIG. 2, this housing includes a lower metal portion 10 of a generally concave shape and the radome or an upper portion 20 of a generally cup-shape which are releasably connected or joined together, with their open sides opposed to each other. As seen from above (FIG. 1), the lower metal portion 10, as well as the radome 20, assumes a generally egg-shape defined by a larger-diameter arc, a smaller-diameter arc and a pair of straight line portions interconnecting the two arcs.

The satellite antenna device for mounting on a moving body, which is adapted to be housed or contained within the housing including the radome, is equivalent to "Vehicle-carried Satellite Broadcasting Receiving Single-layer Structure Leaky-wave Waveguide Cross-Slot Array Antenna" disclosed in the above-mentioned Technical Report of "Institute of Electronic Information Communication" (Vol. 93 No. 40), and a beam tilt angle in this antenna device is set to 52°. The wave angle of this leaky-wave waveguide cross-slot flat array antenna may be varied in three steps, that is, 0° and −5°.

The lower metal portion 10 of the housing comprises a generally egg-shaped bottom wall 11 of a thin metal sheet, and a side or peripheral wall 12 of a thin metal sheet formed by bending at a peripheral edge of the bottom wall 11. As shown in FIG. 2, a rotation support mechanism 2 is fixedly mounted on a larger-diameter arc portion of the bottom wall 11 at the center of a circle in which the above-mentioned larger-diameter arc lies. An antenna body 1 is supported by this rotation support mechanism 2 rotatable about an axis perpendicular to the bottom wall 11. An azimuth motor 4 is fixedly mounted on the bottom wall 11 at a position near to a peripheral edge of a smaller-diameter arc portion thereof, the azimuth motor 4 being connected via a belt 3 to the rotation support mechanism 2 for rotating the same.

Ribs are formed on the larger-diameter arc portion of the bottom wall 11, and are raised and indented axially in such a manner that the raised and indented portions are distributed circumferentially in a predetermined pattern to provide a sufficient strength for supporting the antenna body 1. A plurality of drain holes also serving as vent holes are formed through the indented portions of these ribs so as to be scattered. Details of this rib structure and the drain holes also serving as the vent holes are described in Japanese Patent Application No. 4,289,498, filed earlier by the Applicant of the present application. The side wall 12 of the lower metal portion 10 has a generally inverted U-shaped cross-section, and includes an inner wall 12*a* raising obliquely from the peripheral edge of the bottom wall 11 to the outerside thereof, and an outer wall 12*b* declining outwardly from an upper end or edge of the inner wall 12*a*.

The upper portion (that is, the radome) 20 includes a generally flat top wall 21 substantially egg-shaped, and a side or peripheral wall 22 declining from a peripheral edge of the top wall 21 to the outerside thereof. The upper portion or radome 20 is injection molded from a resin such as "ABK" as an integral construction, using a mold having a cavity identical in shape to that of the upper portion 20. In the assembling of this housing, a lower end portion of the side wall 22 of the upper portion 20 is held in contact with the obliquely downwardly-extending outer wall 12*b* of the inverted U-shaped side wall 12 of the lower portion 10, thus forming a surface of contact between the lower end portion of the side wall 22 and the outer wall 12*b*. Preferably, this contact surface should have a sufficient size to maintain a close contact between the side walls of the upper and lower portions 20 and 10 and a watertight seal therebetween.

In order to secure the contact surface of such a size, it is preferred that the rigidity of the side wall 12 of a thin metal sheet to withstand a deformation toward the center thereof should be smaller than the rigidity of the thicker side wall 22 of a resin. Therefore, the side wall 12 of the lower portion 10 is formed to be expanded slightly .radially outwardly, and when the upper portion 20 is fitted on the side wall 12, the side wall 22 of the upper portion 20 slightly compresses and deforms the side wall 12 radially inwardly toward the center thereof, thereby forming the relatively large surface of contact between the two.

The wall thickness of the radome (upper portion) 20 is 0.6–3 mm, and the radome 20 is so arranged that when the flat array antenna 1 is horizontally mounted in position, the distance from the radome 20 to this flat array antenna 1 is about 5–25 mm, typically 20 mm. In the assembling of this housing, the lower end portion of the side wall 22 of the upper portion 20 is held in contact with the declined outer wall 12*b* of the inverted U-shaped side wall 12 of the lower metal portion 10, thus forming the surface of contact between the lower end portion of the side wall 22 and the outer wall 12*b*.

The antenna housing of this embodiment including the radome 20 further includes screw mechanisms 31 releasably interconnecting the side walls 22 and 12 of the upper and lower portions 20 and 10 at the surface of contact therebetween, and a covering member 32 in the form of a thin rubber strip which is fitted on the side wall 22 of the upper portion 20 to cover the screw mechanisms 31. The covering member 32 made of rubber, having elasticity and a watertight property, compensates for the lowering of the watertightness at those portions where screw holes of the screw mechanisms are formed, and also compensates for the lower watertightness developing over the entire periphery due to an incomplete contact between the upper and lower side walls 22 and 12. Furthermore, the elastic strip-like covering member 32 urges the side wall 22 of the radome 20 into close contact with the side wall 12 of the lower metal portion 10, thus performing the function of enhancing the mechanical connection between the lower portion 10 and the upper portion 20 achieved by the screw mechanisms 31. The strip-like covering member 32 has a plurality of recesses which receive heads of screws of the screw mechanisms, respectively. This housing is fixedly attached, for example, to the top of the moving body by four metal fasteners 5*a* to 5*d* formed at its outer peripheral portion in spaced relation to one another.

Figure 3:
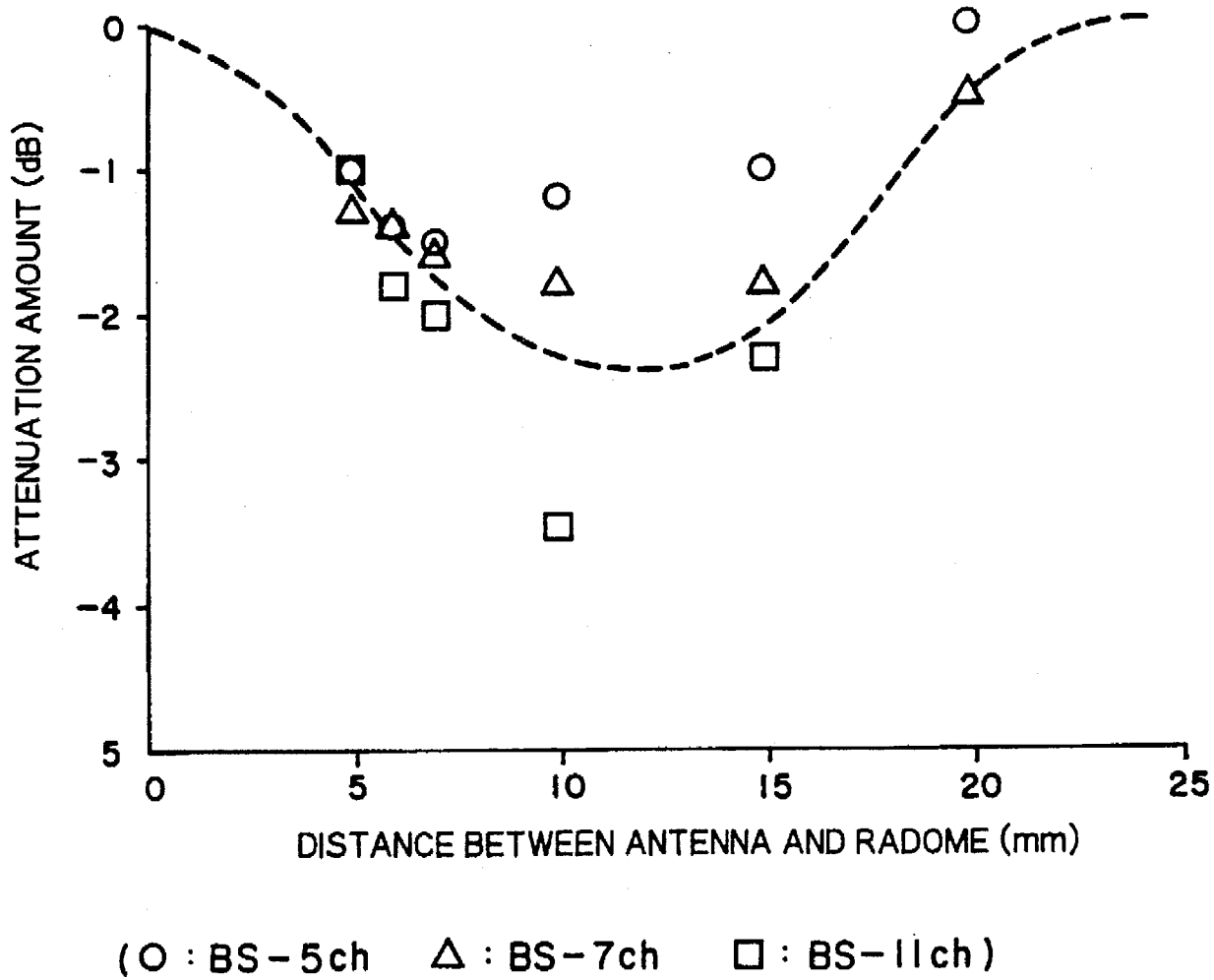
FIG. 3 is a diagram showing the relation between the amount of a receiving gain of the flat array antenna and the wall thickness of the radome.
Figure 4:
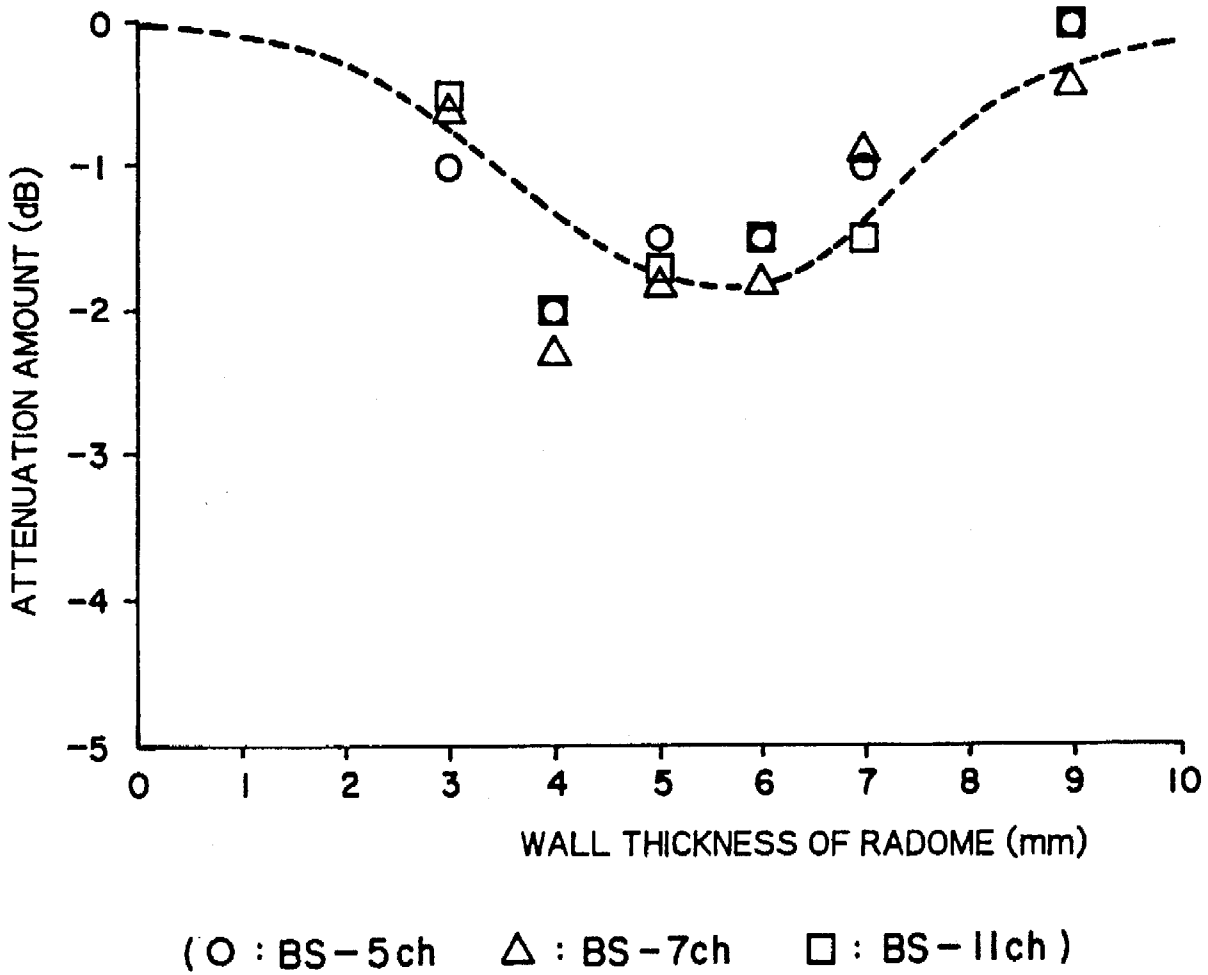
FIG. 4 is a diagram showing the relation between the amount of the receiving gain of the flat array antenna and the distance between the radome and the antenna.
Figure 5:
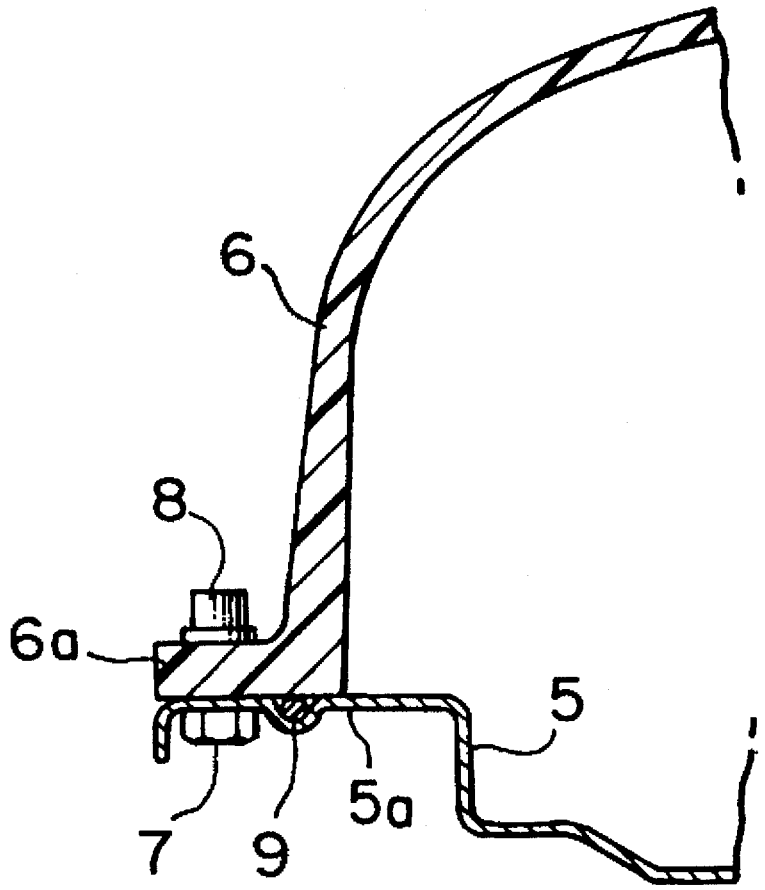
FIG. 5 PRIOR ART
FIG. 5 is a fragmentary, cross-sectional view showing a peripheral edge portion of a conventional housing for a satellite antenna device.

FIG. 3 shows test data indicating how, when a 3 mm thick sheet of resin "ABK" used as a material for the radome of this embodiment was placed above the flat array antenna of FIG. 2, a receiving gain of the antenna varied depending on the distance between the resin sheet and the antenna. FIG. 4 shows test data indicating how, when the distance between the resin sheet and the antenna was fixed to 5 mm, the antenna gain varied depending on the thickness of the resin sheet. In FIGS. 3 and 4, mark ○, mark Δ and mark □ respectively represent results of measurements for 11.804 GHz, 11.842 GHz and 11.919 GHz which are the center frequencies of Channel 5, Channel 7 and Channel 11, respectively.

It will be appreciated from the test results of FIG. 3 that the amount of lowering of the gain, as well as the frequency dependency, is conspicuous when the distance between the two is near to a half-wave length (12.5 mm), and that the amount of lowering of the gain, as well as the frequency dependency, decreases as the distance between the two goes away from this value toward "0" wavelength and toward "1" wavelength. If this distance varies from the above value toward "0" wavelength, the changing of the wave angle is adversely affected, and therefore in this embodiment the distance varies from the above value toward "1" wavelength, and is set to 20 mm. It will be appreciated from the test results of FIG. 4 that the amount of lowering of the gain is conspicuous when the wall thickness of the radome is near to a quarter (6.3 mm) of the wavelength, and that the amount of lowering of the gain decreases as the wall thickness varies from this value toward "0" wavelength and toward the half-wave length. If the thickness varies from the above value toward the half-wave length, the wall thickness of the radome becomes unduly large, and is increased in weight. Therefore, in this embodiment, the wall thickness varies from the above value toward "0" wavelength, and is set to 3 mm in view of the required strength. The amount of lowering of the gain will not increase simply with the increase of the wall thickness, and also depends on the distance between the radome and the antenna, and therefore it is clear from this that the amount of lowering of the gain is not attributable merely to a transmission loss of waves and a reflection loss at the surface of the radome.

Although the present invention has been described with reference to the satellite antenna device for mounting on a moving body, the radome of the present invention can also be suitably applied to a fixed-type antenna device for mounting on a house or a building.

As described above, with the use of the radome of the present invention, the amount of lowering of the receiving gain of the flat array antenna can be kept to a minimum.

In the above housing for the antenna device, in order to ensure the watertightness of the contact surface between the side walls of the upper and lower portions of the housing, and particularly the water-tightness of those portions where the screw mechanisms are provided, the covering member 32 made of rubber is used. However, the use of the covering member 32 may be omitted, for example, where the water-tightness of such screw mechanism-mounted portions is ensured by the use of lock paint.

The upper portion of the present invention housing is in the form of a simple cup having no flange at its peripheral edge, and therefore a mold required for injection molding the upper portion is simple in configuration, and the manufacturing cost of the mold and hence the manufacturing cost of the housing are reduced.

In the housing of the invention, the screw mechanisms, releasably connecting the upper and lower portions of the housing together at the area of contact therebetween, is covered by the covering material including a strip having a waterproof property and elasticity, and therefore the required watertight seal between the upper and lower portions of the housing is ensured.

In the above embodiment of the present invention, the housing for the rotation support portion, rotatably supporting the antenna body, and the azimuth motor provided adjacent to the rotation support portion, assume a generally egg-shape as seen from above, and therefore has an advantage that the area of the housing is smaller as compared to the conventional housing having a circular shape.

What is claimed is:

1. A housing for a satellite antenna device for mounting on a moving body, the antenna device including a satellite antenna body and an automatic tracking mechanism, said housing comprising:

a lower portion made of metal and including a bottom wall on which said antenna device is fixedly secured, and a side wall of a generally inverted U-shaped cross-section which extends upwardly outwardly from a peripheral edge of said bottom wall, and then extends obliquely downwardly;

an upper portion releasably connected to said lower portion in a watertight manner, said upper portion being made of a dielectric material and including a generally flat top wall, and a side wall extending from a peripheral edge of said top wall obliquely downwardly outwardly to be held in contact with the obliquely downwardly-extending portion of said inverted U-shaped side wall of said lower portion, thus forming a contact surface therebetween; and fastening means for releasably fastening said side walls of said upper and lower portions together while firmly maintaining watertight contact at said contact surface which is formed by contacting said inverted U-shaped side wall of the lower portion with a side surface of said upper portion, said fastening means surely holding a distance between said upper portion and a surface of said antenna body so as to receive electric wave from a satellite in a state of maximum gain at said contact surface.

2. A housing according to claim 1, wherein said fastening means includes screw members.

3. A housing according to claim 2, further comprising a strip-like covering member having a waterproof property and elasticity, said covering member being mounted on said side wall of said upper portion to cover said fastening means.

4. A housing according to claim 3, in which said strip-like covering member has a plurality of recesses which receive heads of screws of said screw members, respectively.

5. A housing according to claim 1, in which said inverted U-shaped side wall of said lower portion is formed of a thin metal sheet, so that the rigidity of said inverted U-shaped side wall to withstand a deformation toward the center thereof is smaller than the rigidity of said side wall of said upper portion.

6. A housing according to claim 1, in which said upper and lower portions each has a generally egg-shape defined by a larger-diameter arc, a smaller-diameter arc and a pair of straight lines interconnected said two arcs, said housing further comprising a rotation support mechanism for rotatably supporting said antenna body, being fixedly mounted on said bottom wall of said lower portion generally at the center of a circle in which said larger-diameter arc lies, and an azimuth motor fixedly mounted on said bottom wall of said lower portion at a position near to a peripheral edge of the smaller-diameter arc portion thereof, said azimuth motor being connected via a belt to said rotation support mechanism for rotating the same.

* * * * *